United States Patent [19]

Tachikawa et al.

[11] Patent Number: 5,015,551

[45] Date of Patent: May 14, 1991

[54] ELECTROPHOTOGRAPHIC LIQUID DEVELOPERS CONTAINING POSITIVELY CHARGED RESIN PARTICLES

[75] Inventors: Hiromichi Tachikawa; Hiroaki Yokoya; Nobuo Suzuki; Syu Watarai, all of Saitama, Japan

[73] Assignee: Fuji Photo Film Co., Ltd, Kanagawa, Japan

[21] Appl. No.: 613,020

[22] Filed: May 23, 1984

Related U.S. Application Data

[63] Continuation of Ser. No. 423,778, Sep. 27, 1982, abandoned.

[30] Foreign Application Priority Data

Sep. 29, 1981 [JP] Japan ..... 56-154115

[51] Int. Cl.[5] ..... G03G 9/12

[52] U.S. Cl. ..... 430/114; 430/115; 430/137

[58] Field of Search ..... 430/114, 115, 137

[56] References Cited

U.S. PATENT DOCUMENTS

| | | | |
|---|---|---|---|
| 3,241,998 | 3/1966 | Oliphant | 430/113 |
| 3,634,251 | 1/1972 | Maeda et al. | 430/137 |
| 3,657,130 | 4/1972 | Machida et al. | 430/137 |
| 3,788,995 | 1/1974 | Stahlz et al. | 430/904 |
| 3,793,234 | 2/1974 | Ormsbee | 430/114 X |
| 3,844,966 | 10/1974 | Nelson | 430/115 |
| 3,900,412 | 8/1975 | Kosel | 430/115 |
| 3,959,153 | 5/1976 | Sadomatsu | 430/109 X |
| 4,081,391 | 3/1978 | Tsubuko et al. | 430/137 |

*Primary Examiner*—J. David Welsh

*Attorney, Agent, or Firm*—Sughrue, Mion, Zinn, Macpeak & Seas

[57] ABSTRACT

An electrophotographic liquid developer is disclosed. The developer is comprised of resin particles dispersed in a high-insulating low dielectric non-aqueous solvent. The resin particles are prepared by polymerizing or copolymerizing a specific styrenic monomer in an organic solvent containing a polymer which is substantially soluble in the organic solvent. The liquid developer is particularly suitable for making a printing plate or sheet by an electrophotographic process.

10 Claims, No Drawings

ELECTROPHOTOGRAPHIC LIQUID DEVELOPERS CONTAINING POSITIVELY CHARGED RESIN PARTICLES

This application is a continuation of application Ser. No. 423,778, filed Sept. 27, 1982 now abandoned.

FIELD OF THE INVENTION

This invention relates to an electrophotographic liquid developer, and more particularly, to an electrophotographic liquid developer comprising a dispersion of resin particles in a high-insulating low-dielectric non-aqueous solvent. The resin particles are prepared by polymerizing a specific monomer in an organic solvent in the presence of a polymer substantially soluble in the organic solvent.

BACKGROUND OF THE INVENTION

Presently, an electrophotographic liquid developer is prepared by finely dispersing a dye or pigment such as Nigrosine, carbon black, etc., in a high-insulating liquid using an alkyd resin. The dispersing is carried out by a known dispersing means such as a ball mill. However, such a liquid developer is liable to cause aggregation or sedimentation with the passage of time. Therefore, difficulties occur in connection with the use of such developers. Other methods have been proposed such as a method of dispersing a pigment or dye using a synthetic polymer composed of a long chain methacrylate or acrylate as the main component and a method of stabilizing a dispersion of toner particles by grafting a polymer to the surface of carbon black. However, the images obtained by such a liquid developer have less resin component at the image portions and the fixing property of the images is not always sufficient. Moreover, when such a liquid developer is used for making a printing plate by utilizing electrophotography, there are difficulties because the sensitivity to the printing ink is insufficient.

In order to overcome these difficulties, a liquid developer has been proposed which is composed of a mixture of an ordinary liquid developer of a dispersion of a pigment or dye, and resin particles, as disclosed in Japanese Patent Application (OPI) No. 54029/79 (the term "OPI" as used herein refers to a "published unexamined Japanese patent application") corresponding to U.S. Pat. No. 3,990,980. The liquid developer composed of the dispersion of pigment particles and resin particles attaches a comparatively large amount of resin components to developed image portions. Accordingly, the image portions are excellent in fixing property and when the liquid developer is used as a developer for making printing plate by utilizing electrophotography, the image portions have good sensitivity for printing ink. However, the liquid developer in which pigment particles and resin particles are simultaneously dispersed is not desirable because the charging characteristics of the resin particles are insufficient as compared to those of the pigment components.

SUMMARY OF THE INVENTION

As the result of various investigations of overcoming the foregoing difficulties, the inventors have attained this invention.

An object of this invention is to provide an electrophotographic liquid developer having dispersed therein resin particles having good positive-charging characteristics as the main component.

Another object of this invention is to provide an electrophotographic liquid developer having dispersed therein a pigment or dye and resin particles as the main components, said resin particles having a good positive charging property.

Yet another object of this invention is to provide an electrophotographic liquid developer having a good fixing property and good printing ink sensitivity.

These and other objects of this invention can be achieved by the present invention.

According to this invention, there is provided an electrophotographic liquid developer mainly comprising resin particles dispersed in a non-aqueous solvent having an electric resistance of higher than $10^9\Omega\cdot$cm and a dielectric constant of less than 3, said resin particles being prepared by polymerizing a monomer represented by the following general formula (I) in an organic solvent having dissolved therein a polymer substantially soluble in the organic solvent:

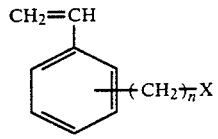

(I)

wherein n represents an integer of 1 to 6 and X represents

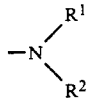

(wherein $R^1$ and $R^2$ independently represent a hydrogen atom, a straight chain, branched, or cyclic alkyl group having 1 to 18 carbon atoms, a phenyl group, or a phenyl group substituted by an alkyl group having 1 to 12 carbon atoms), a morpholino group, or a piperazino group.

According to another embodiment of this invention, there is further provided an electrophotographic liquid developer mainly comprising a pigment or dye and resin particles dispersed in a non-aqueous solvent having an electric resistance of higher than $10^9\Omega\cdot$cm and a dielectric constant of less than 3, said resin particles being prepared by polymerizing a monomer represented by the foregoing general formula (I) in an organic solvent having dispersed therein a polymer substantially soluble in the organic solvent.

DETAILED DESCRIPTION OF THE INVENTION

Examples of useful non-aqueous solvents having an electric resistance of higher than $10^9\Omega\cdot$cm and a dielectric constant of less than 3 include such solvents as straight chain or branched aliphatic hydrocarbons, alicyclic hydrocarbons, aromatic hydrocarbons, and halogenated hydrocarbons. However, from the viewpoints of volatility, stability, toxicity, and odor, isoparafiinic petroleum solvents are suitable. Preferable examples of such isoparaffinic petroleum solvents are Isopar G, Isoper H, Isoper L, etc. (trade names, made by Esso Chemical Co.,).

Isopar G, isopar H and Isopar L contain saturated hydrocarbons in an amount of 99.8%, 99.3%, and 99.5% by weight, respectively, and aromatic hydrocarbons in an amount of 0.2%, 0.2%, and 0.2% by weight, respectively. However, Isopar H contains less than 0.5% by weight of olefin. The boiling points of these liquids are 158° to 177° C. 174° to 189° C., and 188° to 210° C.

In general, any organic solvent can be used in the preparation of the resin particle dispersion used in this invention, provided that the solvent is miscible with the carrier liquid for the liquid developer. However, it is preferred to use the same solvent as the carrier liquid for the liquid developer and an aliphatic hydrocarbon solvent such as hexane, octadecane, etc., or the foregoing isoparaffinic petroleum solvent such as Isopar G, Isopar H, and Isopar L.

The polymer substantially soluble in these solvents (hereinafter, such a polymer is referred to as the soluble polymer) acts as a dispersion stabilizer when preparing resin particles by polymerizing the monomer represented by the general formula (I) in the aforesaid organic solvent to deposit a polymer which is insoluble with respect to these solvents (hereinafter, such a polymer is referred to as the insoluble polymer). When the aforesaid solvent is an aliphatic hydrocarbon solvent, a polymer containing the alkyl ester having 4 to 18 carbon atoms of acrylic acid or methacrylic acid described in U.S. Pat. No. 3,232,903 or the graft copolymer described in Japanese Patent Publication No. 23350/65 can be used as the soluble polymer. Practical examples of the soluble polymer include a polymer of a long chain alkyl ester such as the stearyl, lauryl, octyl, or 2-ethylhexyl ester of acrylic acid or methacrylic acid; a copolymer of the foregoing long chain alkyl ester and a lower alkyl ester such as the methyl, ethyl, or propyl ester of acrylic acid or methacrylic acid; a copolymer of the foregoing long chain alkyl ester and a styrene derivative such as styrene, vinyltoluene, and α-methylstyrene; a copolymer of the foregoing long chain alkyl ester and a vinyl monomer such as acrylic acid, methacrylic acid, (diethylaminoethyl) methacrylate, hydroxyethyl methacrylate, vinylpyrrolidone, vinylpyridine, diacetoneacrylamide, etc.; and a graft copolymer preparing by grafting the aforesaid vinyl monomer to the long chain alkyl ester of acrylic acid or methacrylic acid as the skeleton polymer.

Examples of useful monomers constituting the resin particles used in this invention include monomers represented by general formula (I) described above (homopolymers) and monomers represented by general formula (I) and a 2nd monomer which is insoluble in the foregoing organic solvent before polymerization but becomes soluble in the organic solvent when the monomer is polymerized.

When an aliphatic hydrocarbon or an isoparaffinic petroleum solvent is used as the foregoing organic solvent, it is preferred that the resin particles are composed of a copolymer of the monomer of general formula (I) containing the 2nd monomer. In particular, when in the monomer represented by general formula (I), $R^1$ and/or $R^2$ is an alkyl group having, for example, 3 to 18 carbon atoms, it is frequently necessary for the resin particles to be copolymers containing the 2nd monomer.

Examples of the 2nd monomer are a lower alkyl ester such as the methyl, ethyl, or propyl ester of acrylic acid or methacrylic acid; a styrene derivative such as styrene, vinyltoluene, and α-methylstyrene; and vinyl acetate.

Resin particles may be prepared by polymerizing the monomer of general formula (I) solely if the polymer formed is insoluble in the polymerization solvent. However, in order to impart a good positively charging property to the resin particles, which is one of the objects of this invention, the resin particles having a sufficient positively charging property can be obtained if the resin particles contain the 2nd monomer as the copolymer component and at least 0.1 mole %, preferably at least 1.0 mole % of the monomer shown by general formula (I).

Practical examples of the monomer shown by general formula (I) are (dimethylaminomethyl)styrene, (diethylaminomethyl)styrene, (dipropylaminomethyl)styrene, (dibutylaminomethyl)styrene, (dihexylaminomethyl)styrene, (dioctylaminomethyl)styrene, (dilaurylaminomethyl)styrene, (distearylaminomethyl)styrene, (dimethylaminoethyl)styrene, (diethylaminoethyl)styrene, (dipropylaminoethyl)styrene, (dibutylaminoethyl)styrene, (dihexylaminoethyl)styrene, (dioctylaminoethyl)styrene, (dilaurylaminoethyl)styrene, (ethylaminomethyl)styrene, (propylaminoethyl)styrene, (butylaminomethyl)styrene, (octylaminoethyl)styrene, (laurylaminomethyl)styrene, (N-methyl-N-phenylaminomethyl)styrene, (N-ethyl-N-phenylaminomethyl)styrene, (N-methyl-N-benzylaminomethyl)styrene, (N-ethyl-N-benzylaminomethyl)styrene, (morpholinomethyl)styrene, (morpholinoethyl)styrene, (piperidinomethyl)styrene, (piperidinoethyl)styrene, and the like.

The resin particles used in this invention are prepared by completely dissolving the soluble polymer which acts as a dispersing agent, the monomer represented by general formula (I), and, if necessary, the 2nd monomer which becomes insoluble in an aliphatic hydrocarbon solvent by being polymerized and performing the polymerization with a known radical polymerization initiator such as benzoyl peroxide, azobisisobutyronitrile, etc. As the polymerization progresses, a polymer insoluble in the aliphatic hydrocarbon solvent (the insoluble polymer) precipitates to form fine resin particles by the dispersing action of the soluble polymer existing in the polymerization system. Accordingly, there is formed a stable dispersion of the resin particles containing the structural recurring unit originated in the monomer represented by general formula (I). The ratio of the soluble polymer to the monomer is 1 to 1/100 by weight.

There are no particular restrictions relating to the pigments and dyes used in this invention and generally known pigments or dyes such as carbon black, Nigrosine, Phthalocyanine Blue, Alkali Blue, Hansa Yellow, Benzidine Yellow, Quinacrine Red, etc., can be used.

The liquid developer of this invention may further contain, if necessary, a known dielectric agent such as a metal salt of di-2-ethylhexylsulfosuccinic acid, a metal salt of naphthenic acid, a metal salt of a higher fatty acid, etc., as well as other additives.

The monomer of general formula (I) used in this invention can be prepared, for example, by the methods illustrated in the following synthesis examples.

SYNTHESIS EXAMPLE 1

Synthesis of (Diethylaminoethyl)styrene

In 300 ml of toluene were dissolved 175.4 g of diethylamine and 152.5 g of chloromethylstyrene and the solution was heated to 60°-70° C. for 13 hours. As the reaction progressed, diethylamine hydrochloride precipitated. After filtering off the hydrochloride, the filtrate was washed with water, dried the layer containing toluene with sodium sulfate anhydride, concentrated, and after the addition of 1 g of di-tert-butylcatechol, the mixture was distilled under reduced pressure to provide 120.2 g of diethylaminomethylstyrene as a colorless liquid having a boiling point of 60° C./2 mm Hg.

SYNTHESIS EXAMPLES 2 TO 5

By following the procedures as in Synthesis Example 1, the monomers shown by the following general formula were prepared by the reaction of chloromethylstyrene and each secondary amine:

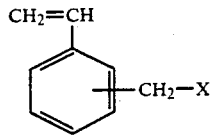

| Synthesis Example | X |
|---|---|
| 2 | Dibutylamino group |
| 3 | Dioctylamino group |
| 4 | Piperidino group |
| 5 | Morpholino group |

SYNTHESIS EXAMPLE 6

Synthesis of (Di-n-butylaminoethyl)styrene

The foregoing monomer was prepared according to the method described in Tsuruta et al., *Makromol. Chem.*, 177, 3255 (1976).

In 100 ml of cyclohexane was dissolved 65.0 g of divinylbenzene (a 55% ethylbenzene solution of a mixture of m-divinylbenzene and p-divinylbenzene) and after adding dropwise thereto an amine-amide complex composed of 64.5 g of di-n-butylamine and 25 mmoles of n-butyl lithium, the mixture was heated to 50° C. for 3 hours. To the reaction mixture was added 1 ml of methanol. After concentrating the mixture, 1 g of di-tert-butylcatechol was added to the residue, and then the resultant mixture was distilled under reduced pressure to provide 53.5 g of (di-n-butylaminoethyl)styrene (a colorless liquid having a boiling point of 100.0°-101.0° C./1 mm Hg).

EXAMPLE 1

In a 500 ml glass vessel equipped with a stirrer, a reflux condenser, and a nitrogen inlet pipe were placed 400 g of Isopar H, 200 g of lauryl methacrylate monomer, and 0.5 g of azobisisobutyronitrile and then the polymerization was performed at 80° C. for 6 hours with stirring under a nitrogen stream to provide polylauryl methacrylate at a polymerization rate of 95%.

In the vessel as used above were placed 200 g of Isopar H, 40 g of methyl methacrylate monomer, 10 g of (diethylamino)styrene monomer, i.e., the monomer prepared in Synthesis Example 1, 0.25 g of azobisisobutyronitrile, and 30 g of an Isopar H solution of aforesaid polylauryl methacrylate and the polymerization was performed at 70° C. for 6 hours with stirring under nitrogen stream to provide a white latex. The resin particles thus obtained showed good positively charging property.

A liquid developer was prepared by diluting 3 g of the dispersion of the resin particles with 1 l of Isopar H. A commercially available zinc oxide-coated paper was electrophotographically image-exposed, developed using the liquid developer thus prepared, fixed by heating, and then subjected to a hydrophilic treatment. When offset printing was performed using the electrophotographic printing sheet thus obtained, good prints were obtained.

EXAMPLE 2

A dispersion of fine Nigrosine particles was prepared by dispersing 10 g of the Isopar H solution of polylauryl methacrylate used in Example 1 and 10 g of Nigrosine (Color Index No. 50415) together with glass beads by means of a paint shaker for 90 minutes.

A liquid developer was prepared by diluting 0.8 g of the Nigrosine dispersion thus obtained and 3 g of the dispersion of the resin particles prepared in Example 1 with 1 l of Isopar H. A commercially available zinc oxide-coated paper was developed using the liquid developer thus prepared, fixed by heating, and then subjected to a hydrophilic treatment. When offset printing was performed using the electrophotographic printing sheet thus obtained, good prints were obtained.

EXAMPLES 3, 4 AND 5

By following the same procedure as Example 1 except that each of the monomers, (dibutylaminomethyl)styrene, piperidinomethylstyrene, and (di-n-butylaminoethyl)styrene prepared in Synthesis Examples 2, 4 and 6, respectively was used in place of the monomer prepared in Synthesis Example 1, liquid developers were prepared.

EXAMPLE 6

In a 500 ml glass vessel equipped with a stirrer, a reflux condenser, and a nitrogen inlet pipe were placed 400 g of Isopar H, 160 g of lauryl methacrylate, 40 g of styrene, and 4 g of azobisisobutyronitrile and the polymerization was performed at 80° C. for 6 hours with stirring under a nitrogen stream to provide copoly(lauryl methacrylate-styrene) at a polymerization rate of 80%.

In the vessel as used above were placed 200 g of Isopar H, 45 g of methyl methacrylate, 5 g of (dioctylaminomethyl)styrene, i.e., the monomer prepared in Synthesis Example 3, 0.25 g of azobisisobutyronitrile, and 30 g of an Isopar H solution of foregoing copoly(-lauryl methacrylate-styrene) and the polymerization was performed at 70° C. for 6 hours with stirring under nitrogen stream to provide a white latex. The resin particles obtained showed good positively charging property.

10 g of Phthalocyanine Blue (Color Index No. 74160), 20 g of an Isopar H solution of polylauryl methacrylate used in Example 1, and 10 g of Isopar H were then dispersed together with glass beads by means of a paint shaker for 90 minutes to provide a Phthalocyanine Blue dispersion.

A liquid developer was prepared by diluting 3 g of the foregoing latex and 0.8 g of the Phthalocyanine Blue dispersion with 1 l of Isopar H. A commercially available zinc oxide-coated paper was developed using the liquid developer thus prepared, fixed by heating, and subjected to a hydrophilic treatment. When offset printing was performed using the electrophotographic printing sheet, good prints were obtained.

EXAMPLE 7

By following the same procedure as Example 5 except that (dibutylaminomethyl)styrene, the monomer prepared in Synthesis Example 2 was used as a monomer for preparing a white latex in place of the monomer prepared in Synthesis Example 3, a liquid developer was prepared.

EXAMPLE 8

By following the same procedure as in Example 5 except that 45 g of styrene and 5 g of (dibutylaminomethyl)styrene monomer, the monomer prepared in Synthesis Example 2 were used as the monomers for preparing a white latex in place of methyl methacrylate and the monomer prepared in Synthesis Example 3, a liquid developer was prepared.

EXAMPLE 9

By following the same procedure as in Example 5 except that 45 g of styrene and 5 g of (di-n-butylaminoethyl)styrene monomer, the monomer prepared in Synthesis Example 6 were used as the monomers for preparing a white latex in place of methyl methacrylate and the monomer prepared in Synthesis Example 3, a liquid developer was prepared.

While the invention has been described in detail and with reference to specific embodiments thereof, it will be apparent to one skilled in the art that various changes and modifications can be made therein without departing from the spirit and scope thereof.

What is claimed is:

1. An electrophotographic liquid developer comprising a resin particle dispersion in a non-aqueous solvent having an electric resistance of higher than $10^9\Omega$ cm and a dielectric constant of less than 3, wherein said resin particle dispersion contains positively charged resin particles and said dispersion is prepared by polymerizing the monomer represented by the following general formula (I)

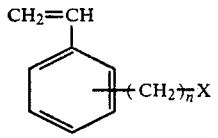

(I)

wherein n represents an integer of 1 to 6 and X represents

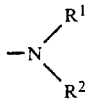

(wherein $R^1$ and $R^2$, which may be the same or different, each represents a hydrogen atom, a straight chain, branched, or cyclic alkyl group having 1 to 18 carbon atoms, a phenyl group, or a phenyl group substituted by an alkyl group having 1 to 12 carbon atoms), a morpholino group, or a piperazino group, in an organic solvent having dissolved therein a polymer substantially soluble in said organic solvent, and said organic solvent has an electric resistance of higher than $10^9\Omega$ cm and a dielectric constant of less than 3, wherein said resin particles are prepared by dissolving both said monomer represented by general formula (I) and said polymer in said organic solvent and carrying out the polymerization with a radical polymerization initiator, wherein said polymer acts as a dispersing agent and the ratio of said polymer to said monomer is 1 to 1/100 by weight, and wherein the developer further contains a pigment or dye in an amount sufficient to effect color.

2. The electrophotographic liquid developer as claimed in claim 1, wherein the resin particles comprise a homopolymer of the monomer represented by general formula (I).

3. The electrophotographic liquid developer as claimed in claim 1, wherein the resin particles comprise a copolymer of two or more kinds of the monomers represented by general formula (I).

4. The electrophotographic liquid developer as claimed in claim 1, wherein the resin particles comprise a copolymer of the monomer represented by general formula (I) and a 2nd monomer and the proportion of the monomer represented by general formula (I) is higher than 0.1 mole %, and the remainder of the copolymer comprises the 2nd monomer.

5. The electrophotographic liquid developer as claimed in claim 4, wherein the proportion of the monomer represented by general formula (I) is higher than 1.0 mole %, and the remainder of the copolymer comprises the 2nd monomer.

6. The electrophotographic liquid developer as claimed in claim 1, wherein the polymer is selected from the group consisting of a polymer containing an alkyl ester having 4 to 18 carbon atoms of acrylic acid or methacrylic acid and a graft copolymer containing the alkyl ester as a skeleton polymer.

7. The electrophotographic liquid developer as claimed in any of claims 4 or 5, wherein the 2nd monomer is selected from the group consisting of an acrylic acid lower alkyl ester, a methacrylic acid lower alkyl ester, a styrene derivative and vinyl acetate.

8. The electrophotographic liquid developer as claimed in claim 1, wherein the non-aqueous solvent is a straight chain or branched aliphatic hydrocarbon or an alicyclic hydrocarbon.

9. The electrophotographic liquid developer as claimed in claim 7, wherein the organic solvent is a straight chain or branched aliphatic hydrocarbon or an alicyclic hydrocarbon.

10. The electrophotographic liquid developer as claimed in claim 1, wherein the non-aqueous solvent and the organic solvent each is selected from the group consisting of an isoparaffinic petroleum solvent, hexane, octane and decane.

* * * * *